US005174563A

United States Patent [19]

Gardien

[11] Patent Number: 5,174,563

[45] Date of Patent: Dec. 29, 1992

[54] DEFLECTING DEVICE

[75] Inventor: Guido I. B. Gardien, Leidschendam, Netherlands

[73] Assignee: Koninklijke PTT Nederland N.V., Groningen, Netherlands

[21] Appl. No.: 760,588

[22] Filed: Sep. 16, 1991

[30] Foreign Application Priority Data

Sep. 19, 1990 [NL] Netherlands ..... 9002061

[51] Int. Cl.[5] ..... B65H 29/52

[52] U.S. Cl. ..... 271/305; 271/293; 271/297

[58] Field of Search ..... 271/293, 297, 305

[56] References Cited

U.S. PATENT DOCUMENTS

| | | | |
|---|---|---|---|
| 3,430,951 | 3/1969 | Hulka et al. | 271/64 |
| 3,672,487 | 6/1972 | Schneider | 271/305 X |
| 4,691,914 | 9/1987 | Lawrence | 271/297 |

FOREIGN PATENT DOCUMENTS

| | | | |
|---|---|---|---|
| 671558 | 2/1939 | Fed. Rep. of Germany . | |
| 48151 | 4/1980 | Japan | 271/297 |
| 746746 | 3/1956 | United Kingdom . | |

*Primary Examiner*—Richard A. Schacher

*Attorney, Agent, or Firm*—Frishauf, Holtz, Goodman & Woodward

[57] ABSTRACT

A compact deflecting device for the conveyance of letters or the like in one of a plurality of selectable directions, is formed by a large number of deflecting components (1-1, --, 1-4) placed at a mutually equal distance along an endless conveyor (15) driven in a main conveyance direction (A). Every component combines a deflecting and conveying function with relatively small space requirement. For this purpose, it comprises not only a downstream-pointing deflecting tongue (4) but also a guide roller (6) which are both mounted on a swivel arm construction (9, 10), which can be swivelled by activating a rotary magnet (2) between two positions. Every component (1-1, --, 1-4) is positioned and dimensioned in a manner such that, when swievelling from one position to the other, the access to a conveyance direction deviating from the main direction is freed or essentially closed off and that, in both positions, the guide roller (6) continues to interact in a conveying manner with the conveyor (15).

5 Claims, 2 Drawing Sheets

DEFLECTING DEVICE

A. BACKGROUND OF THE INVENTION

1. Field of the Invention

Figure 1:
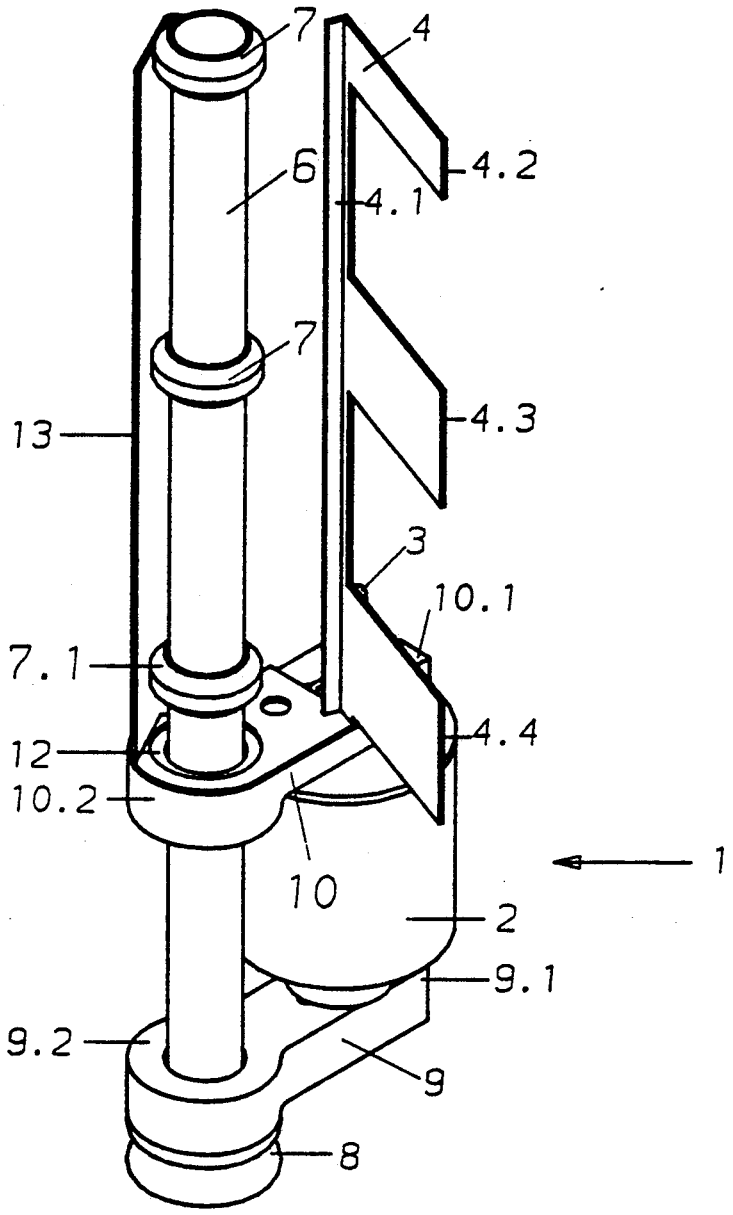

The invention relates to deflecting devices in sorting machines for sorting essentially flat objects such as letters. More particularly, the invention is directed at a deflecting device for guiding letters into one of a plurality of selectable directions as input to, for example, a buffer system for the purpose of electronically sorting letters provided with a sorting code.

2. Prior Art

Such a deflecting device with a buffer system adjoining it and containing a number of buffer positions for the temporary storage of individual letters for the purpose of a sorting process is known from reference [1] mentioned below under C. A single endless conveyor forming a main conveyor track runs over the entire length at the input side of said buffer system. Each buffer position in the buffer system is formed by two interacting endless conveyor belts, one of which, upstream of the input to the buffer position, interacts in each case, while also running parallel over a certain length, with the endless conveyor for the purpose of conveyance in the on-going main conveyance direction. Situated opposite each buffer input on the other side of the conveyor, and therefore pointing downstream, are deflecting means with which it is possible, on command (of a control signal originating from a control device), to intervene in the main conveyor track in order to route a particular letter to the buffer position corresponding to the deflecting means. The deflecting means suggested by this known technique are those of the roller type which, at the position of the endless conveyor, push in the direction of the buffer input. However, this known technique has the following drawbacks. The chosen sorting process is such that all the stored letters must be able to leave the buffer system simultaneously via an outgoing conveyor track running parallel to the input conveyor track. This implies that the width of each buffer position, that is to say, also the distance between two consecutive input deflecting positions, must at least be larger than the maximum length of letter permissible for the system. For a large number of buffer positions, necessary for a flexible buffer sorting process, this condition requires an unacceptably high space occupancy. Although this minimum width will be capable of reduction if the principle of simultaneous ejection is abandoned, the chosen manner of conveyance along the main conveyance direction does not permit any appreciable reduction. In addition, in the case of on-going conveyance in the main direction, a direction deviating from the latter and not selected is not screened off, as a result of which conveyance in an unintended direction is not excluded under some circumstances.

Such a deflecting device in which, in the event of on-going conveyance in the main direction, each selectable direction deviating therefrom and not chosen is, however, in fact screened is known from reference [2]. The screening is done with the aid of what is described as a trap, which has a V-shaped cross section and is rotatable at the root. In the closed state, the traps form an essentially continuous sliding surface with a first side wall. Arranged opposite each of said first side walls is a deflecting roller. A driven endless conveyor belt extends between the successive first side walls of the traps and the successive deflecting rollers in a manner such that letters clamped between conveyor belt and the continuous sliding surface can be conveyed in a sliding-/entraining conveyor in the main direction. The other side wall of every trap, also provided with a sliding surface, forms a sliding wall of the directly preceding selectable direction in :he closed state. For the deviation of a letter in a particular selectable direction, the appropriate trap is opened by turning it away from the conveyor belt. At the same time, the associated deflecting roller is turned in the direction of the opening formed under these circumstances, the conveyor belt at this point being deflected from the main direction and, as a consequence, being able to convey an approaching letter in the desired selectable direction. This known deflecting device has the following disadvantages. Although every selectable direction not chosen in the event of on-going conveyance in the main direction is well screened, in the event of deviation in a selectable direction leading away from the main direction, the on-going direction is, on the contrary, not well screened as a consequence of the use of roller-type deflecting means. Flexible letters which continue to stick to the conveyor belt, for example, as a consequence of static electricity, will not, or will only poorly, be deflected. To execute the deflecting function, the deflecting roller has to force the belt aside, and this makes a relatively large energisation necessary, permits only a limited deviation angle and, in addition, operates sluggishly and inaccurately. During deviation from the main direction to a selectable direction, there is no clamping in situ and therefore no well-defined conveyance of the letter.

Another such deflecting device used in a buffer system having a number of buffer positions for the temporary storage of individual letters for the purpose of a sorting or a video coding process is known from reference [2] mentioned under C. This known deflecting device comprises, for each buffer position, a deflecting tongue which, in the quiescent state, completely closes off the access to the buffer position like a door. The buffer positions form a row of buffer positions which adjoin a common main conveyor track, as it were, like 'scales' at an angle of approximately 30°. Said main conveyor track is formed by an endless conveyor which can interact in a sliding/entraining conveyor system with sliding means mounted on an outside of the deflecting tongue. In the activated state, the deflecting tongue intervenes as a pointing-upstream deflector in the conveyance along the main conveyor track and causes a letter approaching therein to deviate in the direction of the buffer position by means of its front. Although this known deflecting device makes a very compact buffer system possible, it is under certain circumstances fairly susceptible to malfunction as a result of using a deflecting device of the pointing-upstream deflector type. Conveyance based on the sliding/entraining principle also imposes very high requirements on the wear resistance of the materials used.

B. SUMMARY OF THE INVENTION

The object of the invention is to deal with the problems mentioned of the two known devices. More particularly, its object in this connection is to provide an alternative deflecting device for use in a buffer system as known from reference [3].

A deflecting device for guiding letters along a conveyor track in one of a plurality of selectable directions, comprising one or more deflecting components placed behind one another along an endless conveyor defining a main conveyor track, in which each deflecting component comprises deflecting means pointing downstream to the conveyor for guiding, or at least permitting, conveyance along the main conveyor track in a first deflecting position and for guiding along a conveyor track deviating therefrom in a second deflecting position, drive means for setting the deflecting means in the first deflecting position or the second deflecting position, and conveyance means which alter their position with the deflecting means, which, when they alter their position, free the access to the deviating conveyor track, or, alternatively, at least essentially close it off, and which, in the first deflecting position, interact with the endless conveyor for the purpose of conveyance along the main conveyor track, has for this purpose, according to the invention, the characteristic that the deflecting means can reach out through the plane of the conveyor and that the conveyance means are positioned so as to be spatially separated from the deflecting means in a manner such that, for the purpose of conveyance in the deviating conveyor track, the latter are also able to interact with the conveyor in the second deflecting position. That is to say, each component with its conveyance means not only conjointly maintains the conveyance in the main conveyor track, but also does so in the deviating conveyance direction if the deflecting means assume the second deflecting position, which promotes the conveyance in that direction. Preferably, the deflecting device furthermore has the characteristic that the deflecting means and the conveyance means are coupled by means of swivel means which project through the plane of the conveyor, which are mounted at one end on a rotating spindle forming part of the drive means and on which the conveyance means are fitted at the other end. This implies that the drive means with their rotating spindle can be positioned with respect to the conveyor in a manner such that, as a result of a small displacement of the conveyance means along a circular arc, said transport means again arrive in an identical interacting position with the conveyor and at the same time free the access to the deviating conveyor track or constrict it. This achieves the result that a letter remains clamped and driven as long as possible at the side of the main conveyor track in both conveyance directions.

It is furthermore preferable, instead of the deflecting roller known from the technique cited above as deflecting means pointing downstream, to use a deflecting tongue which is mounted between the rotating spindle and the conveyance means on a swivel arm forming part of the swivel means and is aligned parallel to the conveyor. A deflecting tongue does in fact permit a more compact concatenation of the deflecting components and does not, like the deflecting roller, need additional pushing force in order to push not only the letter but also a conveyor belt forming the conveyor. In still another preferred embodiment, the conveyance means are formed by a guide roller mounted in the swivel arm. Such a guide roller conjointly rotating with a deviating letter makes possible a smooth, frictionless deviation in the inside bend of the deviation, while said roller also continues to maintain the conveying interaction with the endless conveyor during the deviation.

Reference [4] furthermore discloses a pointing-upstream deflecting tongue with an associated guide roller which alters its position simultaneously with the deflecting tongue, and which is driven, in a position of the deflecting tongue deviating from the main conveyance direction, by an endless conveyor belt defining the main conveyance direction and, as a result, is also able to interact in a conveying manner with a side wall of the deflecting tongue.

Further preferred embodiments of the deflecting device according to the invention are described in the other subordinate claims and are explained in greater detail, with the invention, in the description of an exemplary embodiment.

C. REFERENCES

[1] U.S. Pat. No. 4,388,994 entitled: Flat-article sorting apparatus;

[2] U.S. Pat. No. 3,430,951 entitled: Mail sorting letter diverter;

[3] EP-A-0429118 (from Applicant) entitled: Buffer system for temporary storage of flat objects such as letters, and buffer for use in said buffer system;

[4] GB-A-746,746 entitled: Convey belt system for the distribution of tickets, letters and the like articles.

D. BRIEF DESCRIPTION OF THE DRAWINGS

Figure 2:
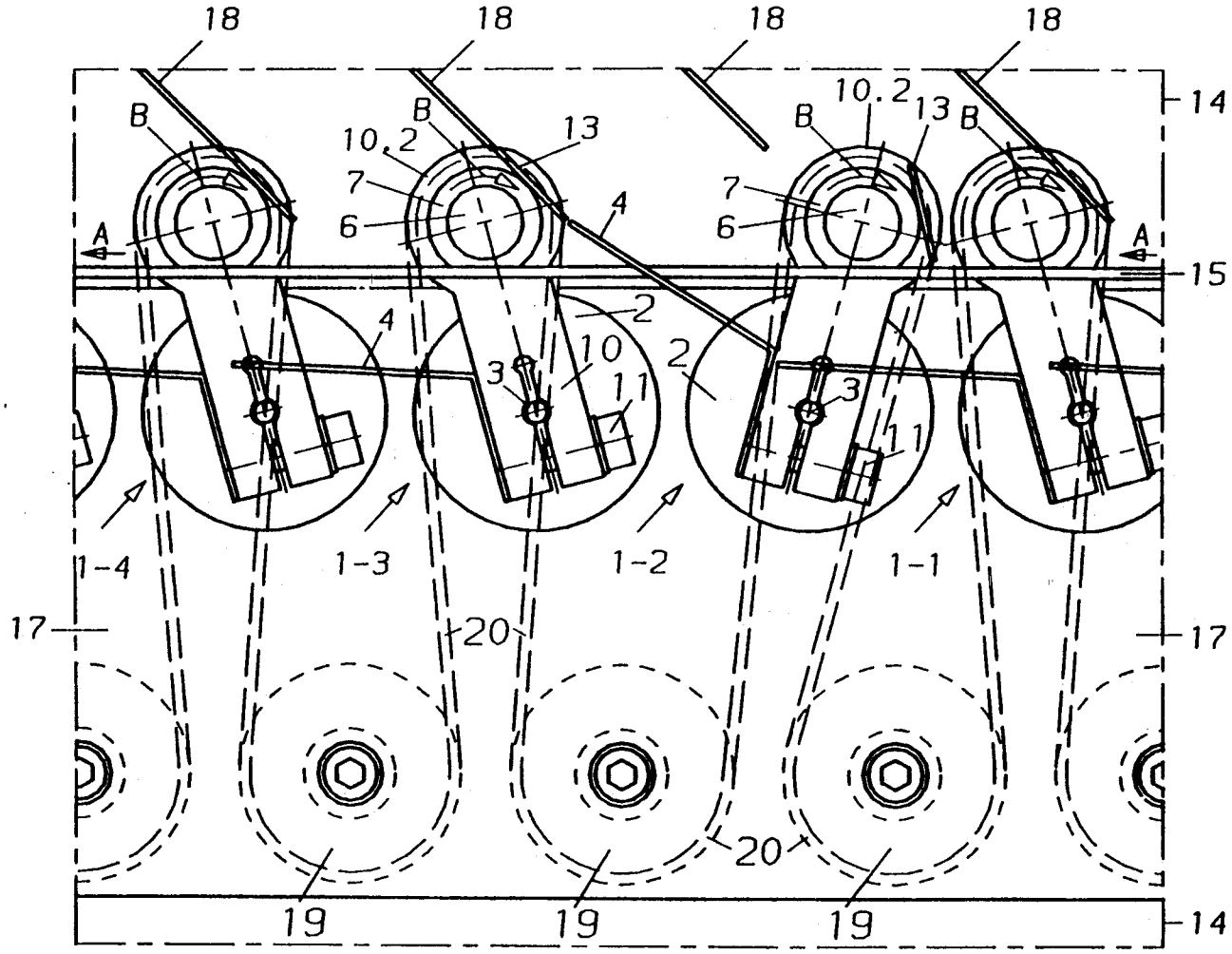

The invention will be explained in greater detail with reference to a drawing, wherein:

FIG. 1 shows a perspective view of a deflecting component for a deflecting device according to the invention, and FIG. 2 diagrammatically shows a plan view in 'window form' of a part of a deflecting device according to the invention.

E. DESCRIPTION OF AN EXEMPLARY EMBODIMENT

FIG. 1 shows an exemplary embodiment of a deflecting component 1 for a deflecting device according to the invention in perspective view. It comprises an electrically activatable rotary magnet 2 having a rotating spindle 3, an E-shaped deflecting tongue 4 with a stem part 4.1 and tongue parts 4.2, 4.3 and 4.4, a guide roller 6 having three protrusions 7 and having a pulley 8 at one end, and two swivel arms 9 and 10. The swivel arms 9 and 10 are mounted at one end by fixing means (for example a screw element 11; see FIG. 2) around the rotating spindle 3, each at one side of the rotary magnet 2. Their other end, 9.2 and 10.2 respectively, has a disc-shaped widened part which accommodates a ball bearing 12 in which the guide roller 6 is mounted by means of the part between the pulley 8 and the proximate protrusion 7.1. The part of the guide roller 6 having the protrusions 7 then extends above the assembly of rotary magnet 2 and arms 9 and 10. Extending parallel to this protrusion section of the guide roller 6 is the deflecting tongue 4 which is mounted by means of the extension of its stem part 4.1 on or at the swivel arm 10. Every protrusion 7 is at the same time at approximately the same height as a tongue part. Close to, but free from the protrusion section of the guide roller there is also a screening plate 13 which is mounted, for example by means of screw means (not shown), on the end 10.2 of the swivel arm 10. The rotary magnet 2 has fixing means (not shown) for the purpose of a rigid connection to terra firma and activating means (also not shown) for energising it, by means of which the deflecting tongue 4 and the guide roller 6 can be transferred by means of the swivel arms 9 and 10 through a preset angle $\alpha$ to a second deflecting position and held there for the duration of the energisation.

FIG. 2 diagrammatically shows a part of an exemplary embodiment of a deflecting device according to the invention. Here, inside a window frame 14, a number of deflecting components (of which four are shown, numbered 1-1, 1-2, 1-3 and 1-4, respectively) are homologously (not taking account of the deflecting position in this connection) positioned consecutively at a mutually equal spacing along an endless conveyor 15 driven in a direction indicated by arrow A. Every component is rigidly connected by means of the rotary magnet 2 to a mounting plate 17 which serves as terra firma, which plate is situated in terms of height directly above the swivel arm 9 (see FIG. 1). The conveyor 15 is formed by two endless, somewhat elastic conveyor belts which run parallel in the same plane and which pass through between deflecting tongue 4 and guide roller 6 of each deflecting component 1. Said conveyor belts are stretched along the guide rollers 6 in a manner such that a letter situated between said conveyor belts and one or more successive guide rollers 6 experiences a laterally directed elastic thrust force against the guide rollers 6 at the position of the letter. This means that every guide roller affected rotates in a direction indicated by an arrow B as soon as and as long as the conveyor 15 is driven. Letters can therefore be conveyed in the conveyance direction A by clamping between the conveyor 15 and the consecutive guide rollers 6. Such a conveyor system is the more reliable, the more guide rollers are involved at the same time in the conveyance of one and the same letter (i.e. small mutual spacing of the rollers with respect to the minimum permitted length of letter of the letters to be processed).

The presence of the protrusions 7 ensures additional clamping, especially to prevent tilting or sagging in the conveyance plane. Depending on the thickness of the letter, the conveyor 15 at the same time deflects laterally, away from the common tangent plane of the consecutive guide rollers 6 in the direction of the deflecting tongue 4. The space between guide roller 6 and deflecting tongue 4 of each component therefore has to be adjusted to (greater than) a maximum permissible thickness of letter. Every deflecting component 1 is positioned in a manner such that, in the first deflecting position, the swivel arms 9 and 10 are at an angle of approximately $90°-\frac{1}{2}\alpha$ with respect to the conveyor 15 and the deflecting tongue 4 is situated completely outside the region which the conveyor 15 can affect by lateral deviation as a function of the thickness of letter. The deflecting tongue 4 is, for example, directed approximately parallel to the conveyor 15, as shown. So long as consecutive deflecting components 1 occupy their first deflecting position, in which position the deflecting components 1-1, 1-3 and 1-4 are shown, letter conveyance can take place along a main conveyor track in the conveyance direction A. Since the consecutive guide rollers are close together, a conveyance direction deviating from the said track is ruled out. If a deflecting component 1 is set to its second deflecting position, a position in which the component 1-2 is shown, the space between its guide roller 6 and the guide roller 6 of the subsequent deflecting component 1-3 is increased and consequently the access to conveyance in that direction is freed; and simultaneously, the deflecting tongue 4, which can reach, as a result of its E-shape, respectively above, between and beneath the conveyor belts by means of the tongue parts 4.2, 4.3 and 4.4, intersects the plane of the conveyor 15 at an acute angle ($\approx\alpha$ in the case shown; in practice, $\alpha\approx 30°$). The deflecting tongue 4 has a length such that, in going over from one deflecting position to the other, it can turn round to a position just in front of the protrusions 7 of the guide roller 6 and the screening plate 13 of the next deflecting component (1-3 in FIG. 2). A letter which now arrives along the main conveyor track according to the arrow A moves aside and consequently bends in the direction in which the tongue is pointing, remaining at the same time clamped and driven between the conveyor 15 and the guide roller 6 of the deflecting component 1-2 with its protrusions 7. The bending of the letter in the deflection direction around the guide roller 6 further intensifies the clamping, certainly in the case of the somewhat thicker or stiffer letters. The screening plate 13 of the next deflecting component in the first deflecting position smoothly adjoins the deflecting tongue 4 of any deflecting component in the second deflecting position (in which positions the components 1-2 and 1-3 are respectively shown). Said screening plate must prevent contact of a deflected letter with the guide roller 6, rotating oppositely to its conveyance direction, of the next component and guide it past the latter. As shown in FIG. 2, a slide plate 18 provided with clamping means (not shown) for picking up a deflected letter can be arranged to smoothly adjoin said screening plate 13 directly. Instead of being mounted in a fixed manner on the swivel arm 10 of a component 1, the screening plate 13 may also be attached pivotably to the end of the slide plate 18 adjoining it, which screening plate, on changing over from the first to the second deflecting position of the component whose guide roller is screened by it, is itself forced aside by the guide roller against a spring pressure.

The reliability of the conveying interaction between the conveyor 15 and the consecutive guide rollers 6 can be increased still further if not only the conveyor but also the guide rollers are driven. For this purpose, at a mutual spacing equal to that at which the deflecting components are placed at the bottom on the mounting plate 17, counterpulleys 19 are mounted at a height corresponding to the pulleys 8. A driven endless elastic belt 20 runs in a zig-zag manner around the pulleys 8 and the counterpulleys 19. Making use of the tension in such a belt, in combination with a favourable positioning of the counterpulleys 19 with respect to the pulleys 8 on the guide rollers 6, torques can be obtained on every swivel arm (9, 10) which can have a supportive effect on the action of the chosen type of rotary magnet 2 in resetting or maintaining a deflecting component in one or each of the two deflecting positions. If, for example, the rotary magnet is of a type having an in-built restoring spring (that is to say, having one preferred position—corresponding to the first deflecting position—and an energised position), it is preferable to place every counterpulley 19 in a manner such that its axis of rotation lies in a central plane perpendicular to the axes of the guide rollers 6 of two consecutive components 1 in their first deflecting position. The spacing between the parallel-running rows of pulleys 8 on guide rollers 6 and counterpulleys 19 is at the same time chosen so that every deflecting component, in changing over from one deflecting position to the other, always passes through a state of labile equilibrium in relation to the elastic forces of the belt. That is to say, if left to itself, the deflecting component is always held in one of two deflecting positions as a result of stretching the belt. Suitable placing of the counterpulleys 19 can even achieve the result that said state of labile equilibrium coincides with the second deflecting position. In that case, the rotary magnet can be one of a cheaper type without restoring spring. This arrangement has the disadvantage, however, that changes in position in one or more deflecting components cause greater disturbances in the distribution of tensioning force in the belt 20, which may result in undesirable irregularities in the conveyance speed of the letters conveyed at that instant in the deflecting device.

Finally, let it be pointed out that the guide roller can also be replaced by a fixed spindle on which resilient slide means similar to those from reference [2] (the flexible elastic flaps 73 in FIG. 4 are intended which are mentioned in the description on page 17, line 36 to page 18, line 12, inclusive) are mounted, for example at the height of each of the tongue parts 4.2, 4.3 and 4.4. Such a design of the invention, however, retains the above-mentioned drawback of the high requirements to be imposed on the materials used.

I claim:

1. Deflecting device for guiding letters along a conveyor track and for deflecting them into a deviating direction, comprising a main conveyor track and deflecting units placed along said main conveyor track, said main conveyor track comprising an endless conveyor adjacent to a guide roller per deflecting unit on the side of the main conveyor track which is in said deviating direction, said deflecting units each comprising said guide roller, a rotary spindle at one side of the main conveyor track mounted so as to rotate about its axis, on which spindle a swivel arm is mounted for swivelling around said axis, said swivel arm having a guiding tongue mounted thereon for guiding said letters along the main conveyor track in a first deflecting position of said swivel arm and for guiding them into a deviating direction, said guiding tongue reaching out through the plane of the conveyor, in a second deflecting position, of said swivel arm, and drive means for moving the swivel arm in rotation from said first deflecting position into said second deflecting position and from said second position into said first position, characterized in that said swivel arm is mounted for swiveling around said axis of said rotary spindle, is affixed to said rotary spindle for being moved by said drive means and is placed on the side of the main conveyor track opposite to the deviation direction and said guide roller is placed on the free movable end of said swivel arm, parallel to said rotary spindle.

2. Deflecting device according to claim 1, characterized in that said rotary spindle is a part of said drive means.

3. Deflecting means according to claim 1, characterized in that in each of said deflection units, said guide roller is provided with a screening plate which adjoins said deflecting tongue of the preceding deflecting unit smoothly in said second deflecting position.

4. Deflecting device according to claim 1, characterized in that a common belt drive is provided for driving the guide rollers of a plurality of deflection units.

5. Deflecting device according to claim 4, characterized in that for the purpose of said belt drive, every said guide roller is provided with a pulley, and in that the pulleys of the guide rollers jointly form, in said first position of all deflecting units, a row of equidistantly arranged pulleys corresponding to a parallel row of counterpulleys arranged equidistantly in a fixed manner, an endless elastic belt being drivably stretched alternately over a pulley and a counterpulley and the tension force in the belt and the positioning of the counterpulleys being matched to one another in a manner such that, in changing over from one deflecting position to the other, every deflecting unit always passes through a state of labile equilibrium with respect to the tension force of the belt.

* * * * *